United States Patent [19]

Bartlett et al.

[11] Patent Number: 4,483,720

[45] Date of Patent: Nov. 20, 1984

[54] PROCESS FOR APPLYING THERMAL BARRIER COATINGS TO METALS

[75] Inventors: Robert W. Bartlett, Tucson, Ariz.; Paul J. Jorgensen, Cupertino, Calif.

[73] Assignee: S R I International, Menlo Park, Calif.

[21] Appl. No.: 325,504

[22] Filed: Nov. 27, 1981

[51] Int. Cl.[3] ..... C23C 11/00

[52] U.S. Cl. ..... 148/6.3; 148/6.35; 427/376.4; 427/376.8

[58] Field of Search ..... 148/6.14 R, 6.2, 6.27, 148/6.3, 6.35; 427/376.3, 376.4, 376.6, 376.8, 380, 436, 435, 377, 226, 383.7

[56] References Cited

U.S. PATENT DOCUMENTS

| | | | |
|---|---|---|---|
| 3,622,234 | 11/1971 | Seybolt et al. | 75/171 |
| 4,229,234 | 10/1980 | Krutenat et al. | 148/6.35 |
| 4,342,792 | 8/1982 | Brown et al. | 427/376.4 |

FOREIGN PATENT DOCUMENTS

| | | | |
|---|---|---|---|
| 131184 | 6/1978 | Fed. Rep. of Germany | 148/6.3 |
| 50-116338 | 9/1975 | Japan | 148/6.14 R |

OTHER PUBLICATIONS

Bonesteel et al., "Mechanical Properties and Structure of Internally Oxidized Niobium-1% Zirconium Alloy", Trans. JIM, vol. 9 pp. 598-601, 1968.

Rowcliffe et al., "Strengthening of Niobium-Zirconium Alloys by Internal Oxidation", Materials Sciences Lab. pp. 741-750.

Jorgensen, "Oxidation-Controlled Aging of $SmCo_5$ Magnets", Journal of the Less-Common Metals, vol. 77 (1981) pp. 221-226.

Jorgensen, "The Influence of the Microstructure on the Internal Oxidation of $SmCo_5$", *Ceramic Microstructures' 76 with Emphasis on Energy Related Applications*, pp. 344-353, 1977.

Bartlett et al., "Microstructure and Growth Kinetics of the Fibrous Composite Subscale . . . " Metallurgical Transactions, vol. 5, Feb. 1974.

Bartlett et al., "Microstructural Changes in $SmCo_5$ Caused by Oxygen Sinter-Annealing and Thermal Aging", J. of the Less-Common Metals, vol. 37, 1974, pp. 21-34.

Jorgensen et al., "Solid-Phase Sintering of $SmCo_5$" Journal of Less-Common Metals, vol. 37, pp. 205-212, 1974.

*Primary Examiner*—Sadie L. Childs

*Attorney, Agent, or Firm*—Edward B. Gregg; Urban H. Faubion

[57] ABSTRACT

Process for applying a protective coating to a metal substrate which provides a thermal barrier and a barrier against oxidation of the substrate. The coating material is a mixture of two metals $M_1$ and $M_2$, e.g., cerium ($M_1$) and cobalt ($M_2$), one of which when exposed to an atmosphere containing a low partial pressure of oxygen and at a high temperature forms a stable oxide, the other of which does not form a stable oxide under such conditions. A coating consisting of such a metal alloy or mixture is subjected to such conditions to produce an outer oxide layer of metal $M_1$ and an inner metal layer of $M_2$ alloyed with one or more components of the substrate. The oxide layer provides thermal and oxidation protection and the inner layer bonds the coating to the substrate.

7 Claims, 2 Drawing Figures

PROCESS FOR APPLYING THERMAL BARRIER COATINGS TO METALS

Figure 1:
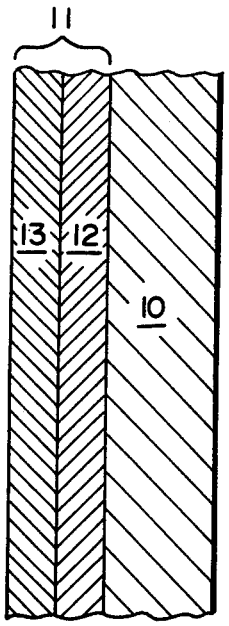

This invention relates to the coating of metals, particularly certain alloys, with a protective coating that acts as a thermal barrier.

Certain alloys known as "super alloys" are used as gas turbine components where high temperature oxidation resistance and high mechanical strengths are required. In order to extend the useful temperature range, the alloys must be provided with a coating which acts as a thermal barrier to insulate and protect the underlying alloy or substrate from high temperatures and oxidizing conditions to which they are exposed.

Zirconium oxide is employed for this purpose because it has a thermal expansion coefficient approximating that of the super alloys and because it functions as an efficient thermal barrier.

Zirconium oxide is applied to alloy substrates by plasma spraying, in which an inner layer or bond coat, for example NiCrAlY alloy, protects the superalloy substrate from oxidation and bonds to the superalloy and to the zirconium oxide. The zirconium oxide forms an outer layer or thermal barrier and the zirconia is partially stabilized with a second oxide such a calcia, yttria or magnesia. The plasma spray technique requires two guns for application; it results in nonuniform coating; and it is not applicable or is difficultly applicable, to re-entrant surfaces. The plasma sprayed coatings often have microcracks and pinholes that lead to catastrophic failure.

Thermal barrier coatings can also be applied using electron beam vaporization. This method of application is expensive and limited to line of sight application. Variations in coating compositions often occur because of differences in vapor pressures of the coating constituent elements.

It is an object of the present investigation to provide improved methods of applying thermal barrier coatings to metal substrates such as the aforesaid super alloys.

It is a particular object of the invention to provide an improved process for applying such coatings to superalloys.

It is another object of the invention to provide structures comprising a substrate of a metal, e.g. a super alloy or the like, having applied thereto a thermal barrier coating in the form of a metal oxide satisfying the requirements of thermal barriers and also resulting in a uniform coating which is substantially free from cracks and other defects and is securely bonded to the substrate.

The above and other objects of the invention will be apparent from the ensuing description and the appended claims.

In accordance with the present invention, an alloy or a physical mixture of metals is provided comprising two metals $M_1$ and $M_2$ which are selected in accordance with the criteria described below. This alloy or metal mixture is then melted to provide a uniform melt which is then applied to a metal substrate by dipping the substrate in the melt. Alternatively, the metal mixture or alloy is reduced to a finely divided state, and the finely divided metal is incorporated in a volatile solvent to form a slurry which is applied to the metal substrate by spraying or brushing. The resulting coating is heated to accomplish evaporation of the volatile solvent and the fusing of the alloy or metal mixture onto the surface of the substrate. (Where physical mixtures of metals are used, they are converted to an alloy by melting or they are alloyed in situ in the slurry method of application.)

The metals $M_1$ and $M_2$ are selected according to the following criteria: $M_1$ forms a thermally stable oxide when it is exposed to an atmosphere containing a small concentration of oxygen such as that produced by a mixture of carbon dioxide and carbon monoxide at a temperature of about 900° C. The metal $M_2$, under such conditions, does not form a stable oxide and remains entirely or substantially entirely in the form of the unoxidized metal. Further, $M_2$ is compatible with the substrate alloy in the sense that it extracts one or more of the components of the substrate to form an intermediate layer between the oxide outer layer (resulting from oxidation of $M_1$) and the substrate, such intermediate layer being an alloy of $M_1$ and the extracted component or components and serving to bond the oxide layer to the substrate.

It will be understood that $M_1$ may be a mixture or alloy of two or more metals meeting the requirements of $M_1$ and that $M_2$ may be a mixture or alloy of two or more metals meeting the requirements of $M_2$.

When a coating of suitable thickness has been applied to the substrate alloy by the dip coating process or by the slurry process described above (and in the latter case after the solvent has been evaporated and the $M_1/M_2$ metal alloy or mixture is fused onto the surface of the substrate) the surface is then exposed to a selectively oxidizing atmosphere such as a mixture of carbon dioxide and carbon monoxide (hereinafter referred to as $CO_2/CO$). A typical $CO_2/CO$ mixture contains 90 percent of $CO_2$ and 10 percent of CO. When such a mixture is heated to a high temperature, an equilibrium mixture results in accordance with the following equation:

$$CO+\tfrac{1}{2}O_2=CO_2$$

The concentration of oxygen in this equilibrium mixture is very small, e.g., at 800° C. the equilibrium oxygen partial pressure is approximately $2\times10^{-7}$ atmosphere, but is sufficient at such temperature to bring about selective oxidation of $M_1$. Other oxidizing atmospheres may be used, e.g., mixtures of oxygen and inert gases such as argon or mixtures of hydrogen and water vapor which provide oxygen partial pressures lower than the dissociation pressures of the oxides of the elements in $M_2$, and higher than the dissociation pressure of the oxide of $M_1$.

The coating thus formed and applied is then preferably subjected to an annealing step. The annealing step may be omitted when annealing occurs under conditions of use.

There results from this process a structure such as shown in FIG. 1 of the drawings.

Referring now to FIG. 1, this figure represents a cross-section through a substrate alloy indicated at 10 coated with a laminar coating indicated at 11. The laminar coating 11 consists of an intermediate metallic layer 12 and an outer oxide layer 13. The relative thicknesses of the layers 12 and 13 are exaggerated. The substrate layer 10 is as thick as required for the intended service.

The layers 12 and 13 together typically will be about 300 to 400 micrometers thick, the layer 12 will be about 250 micrometers thick, and the layer 13 will be about 150 micrometers thick. It will be understood that the layers 12 and 13 will have thicknesses adequate to form a firm bond with the substrate and to provide an adequate thermal and oxidation barrier.

The metals $M_1$ and $M_2$ may, depending upon the type of service and the nature of the substrate alloy, be selected from Tables I and II, respectively.

TABLE I

| ($M_1$) | | | |
|---|---|---|---|
| Lanthanum | La | Holmium | Ho |
| Cerium | Ce | Erbium | Er |
| Praseodymium | Pr | Thulium | Tm |
| Neodymium | Nd | Ytterbium | Yb |
| Samarium | Sm | Lutetium | Lu |
| Europium | Eu | Actinium | Ac |
| Gadolinium | Gd | Thorium | Th |
| Terbium | Tb | Zirconium | Zr |
| Dysprosium | Dy | Hafnium | Hf |

TABLE II

| ($M_2$) | |
|---|---|
| Nickel | Ni |
| Cobalt | Co |
| Aluminum | Al |
| Yttrium | Y |
| Chromium | Cr |
| Iron | Fe |

It will be understood that two or more metals chosen from Table I and two or more metals chosen from Table II may be employed to form the coating alloy or mixture. Examples of suitable $M_1/M_2$ metal mixtures are

TABLE III

| $M_1$ | | $M_2$ |
|---|---|---|
| Ce | + | Co |
| Ce | + | Ni |
| Ce | + | Co/Cr |
| Ce | + | Ni/Cr |
| Zr | + | Co |
| Zr | + | Ni |
| Sm | + | Co |
| Sm/Ce | + | Co |

Proportions of $M_1$ and $M_2$ may vary from about 50 to 90% by weight of $M_1$ to from about 10 to 50% by weight of $M_2$, preferably about 70 to 90% of $M_1$ and about 10 to 30% of $M_2$. The proportion of $M_1$ should be sufficient to form an outer oxide layer sufficient to provide a thermal barrier and to inhibit oxidation of the substrate and the proportion of $M_2$ should be sufficient to bond the coating to the substrate.

It will be noted that most of the metals in Table I are metals of the lanthanide series of elements. Such metals and zirconium are the preferred choice for $M_1$.

Table IV provides examples of substrate alloys to which $M_1/M_2$ are applied in accordance with the present invention. It will be noted that the invention may be applied to superalloys in general and specifically to cobalt and nickel based super alloys.

TABLE IV

| | |
|---|---|
| Nickel Base Superalloy | IN 738 |
| Cobalt Base Superalloy | MAR-M509 |
| NiCrAlY Type Bond Coating Alloy | |
| CoCrAlY Type Bond Coating Alloy | |

The invention may also be applied to any metal substrate which benefits from a coating which is adherent and which provides a thermal barrier and/or protection from oxidation by the ambient atmosphere.

The dip coating method is preferred. In this method a molten $M_1/M_2$ alloy is provided and the substrate alloy is dipped into a body of the coating alloy. The temperature of the alloy and the time during which the substrate is held in the molten alloy will control the thickness of the coating. The thickness of the applied coating can range between 100 micrometers to 1000 micrometers. Preferably, a coating of about 300 micrometers to 400 micrometers is applied. It will be understood that the thickness of the coating will be provided in accordance with the requirements of a particular end use.

The slurry fusion method has the advantage that it dilutes the coating alloy or metal mixture and therefore makes it possible to effect better control over the thickness of coating applied to the substrate. Typically, the slurry coating technique may be applied as follows: An alloy of $M_1$ and $M_2$ is mixed with a mineral spirit and an organic cement such as Nicrobraz 500, (Well Colmonoy Corp.) and MPA-60 (Baker Coaster Oil Co.). Typical portions used in the slurry are coating alloy 45 weight percent, mineral spirit 10 weight percent, and organic cement, 45 weight percent. This mixture is then ground, for example, in a ceramic ball mill using aluminum oxide balls. After separation of the resulting slurry from the alumina balls, it is applied (keeping it stirred to insure uniform dispersion of the particles of alloy in the liquid medium) to the substrate surface and the solvent is evaporated, for example, in air at ambient temperature or at a somewhat elevated temperature. The residue of alloy and cement is then fused onto the surface by heating it to a suitable temperature, for example, 1250° C. in an inert atmosphere such as argon that has been passed over hot calcium chips to getter oxygen. The cement will be decomposed and the products of decomposition are volatilized.

The following specific example will serve further to illustrate the practice and advantages of the invention.

EXAMPLE 1

The substrate was a nickel base superalloy known as IN 738, which has a composition as follows:

| | | | |
|---|---|---|---|
| 61% | Ni | 1.75% | Mo |
| 8.5% | Co | 2.6% | W |
| 16% | Cr | 1.75% | Ta |
| 3.4% | Al | 0.9% | Nb |
| 3-4% | Ti | | |

The coating alloy was in one case an alloy containing 90 percent cerium and 10 percent cobalt, and in another case an alloy containing 90 percent cerium and 10 percent nickel. The substrate was coated by dipping a bar of the substrate alloy into the molten coating alloy. The temperature of the coating alloy was 600° C., which is above the liquidus temperatures of the coating alloys. By experiment it was determined that a dipping time of about one minute provided a coating of satisfactory thickness.

The bar was then extracted from the melt and was exposed to a $CO_2/CO$ mixture containing 90.33 percent $CO_2$ and 9.67 percent CO. The exposure periods ranged from 30 minutes to two hours and the temperature of exposure was 800° C. The equilibrium oxygen partial pressure of the $CO_2/CO$ mixture at 800° C. is $2.25\times10^{-17}$ atmosphere, and at 900° C. it is $7.19\times10^{-15}$ atmosphere. The dissociation pressures of CoO were calculated at 800° and 900° to be $2.75\times10^{-16}$ atmosphere and $3.59\times10^{-14}$ atmosphere, respectively, and the dissociation pressures of NiO were calculated to be $9.97\times10^{-15}$ atmosphere and $8.98\times10^{-13}$ atmosphere respectively. Under these circumstances neither cobalt nor nickel was oxidized.

Each coated specimen was then annealed in the absence of oxygen in a horizontal tube furnace at 900° or 1000° C. for periods up to two hours. This resulted in recrystallization of oxide grains in the intermediate layer.

Figure 2:
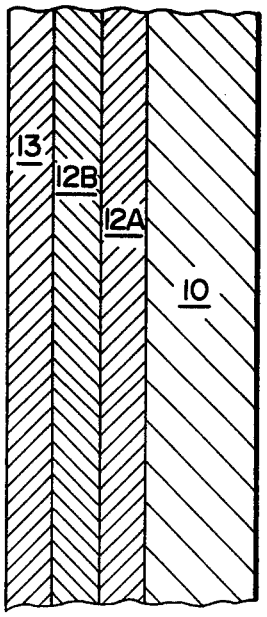

Examination of the treated specimens, treated in this manner with the cerium cobalt alloy, revealed a structure in cross-section as shown in FIG. 2. In FIG. 2, as in FIG. 1, the thickness of the various layers is not to scale, thickness of the layers of the coating being exaggerated.

Referring to FIG. 2, the substrate is shown at 10, an interaction zone at 12A, a subscale zone at 12B and a dense oxide zone at 13. The dense oxide zone consists substantially entirely of $CeO_2$; the subscale zone 12B contains both $CeO_2$ and metallic cobalt and the interaction zone 12A contains cobalt and one or more metals extracted from the substrate.

Similar results are obtained using a cerium-nickel alloy containing 90% cerium and 10% nickel.

Such coatings provide thermal barriers suitable for such uses as described above, they are adherent, and they do not undergo unacceptable deterioration in use.

We claim:

1. A method of coating a metal substrate with a protective coating which comprises:

(a) providing a substrate metal to be coated, said substrate being a structural article suitable for use in a mechanical structure having high mechanical strength, (b) providing an alloy or mixture of at least one metal $M_1$, and at least one other metal $M_2$ selected according to the following criteria:

(1) $M_1$ is susceptible to oxidation by molecular oxygen at an elevated temperature in an atmosphere having a very small partial pressure of oxygen, such oxidation resulting in a stable oxide of $M_1$, (2) $M_2$ does not form a stable oxide under such conditions and it forms an alloy with at least one component of the substrate on heat treatment of the coated material;

(c) applying such alloy or mixture to a surface of the substrate, under conditions such that the surface only is coated with an alloy of $M_1$ and $M_2$ and (d) effecting selective oxidation of $M_1$ at an elevated temperature in the coating without substantial oxidation of $M_2$, (e) the proportion of $M_1$ to $M_2$ in said alloy or mixture of $M_1$ and $M_2$ being substantial and sufficient to result in a coating containing sufficient oxide of $M_1$ to function as a substantial thermal barrier, (f) the quantity of $M_1$ and $M_2$ being adequate to form a firm bond with the substrate and to form a substantial thermal barrier.

2. The method of claim 1 wherein after step (d) the coating is annealed.

3. The method of claim 1 wherein the substrate metal is a superalloy.

4. The method of claim 1 wherein $M_1$ is selected from the lanthanide metals.

5. The method of claim 4 wherein $M_1$ is cerium.

6. The method of claim 1 wherein $M_2$ is selected from the group nickel, cobalt, aluminum, yttrium, chromium and iron.

7. The method of claim 1 wherein the $M_1$ is cerium, $M_2$ is cobalt or nickel and the substrate metal is a superalloy.

* * * * *

REEXAMINATION CERTIFICATE (645th)

United States Patent [19]

Bartlett et al.

[11] B1 4,483,720

[45] Certificate Issued Mar. 10, 1987

[54] PROCESS FOR APPLYING THERMAL BARRIER COATINGS TO METALS

[75] Inventors: Robert W. Bartlett, Tucson, Ariz.; Paul J. Jorgensen, Cupertino, Calif.

[73] Assignee: S R I International, Menlo Park, Calif.

Reexamination Request:
No. 90/000,825, Jul. 22, 1985

Reexamination Certificate for:

| | |
|---|---|
| Patent No.: | **4,483,720** |
| Issued: | **Nov. 20, 1984** |
| Appl. No.: | **325,504** |
| Filed: | **Nov. 27, 1981** |

[51] Int. Cl.[4] ..... C23C 11/00; C23C 8/10

[52] U.S. Cl. ..... 148/6.3; 148/6.35; 427/376.4; 427/376.8

[56] References Cited

FOREIGN PATENT DOCUMENTS 1086708 10/1967 United Kingdom .
1396898 6/1975 United Kingdom .
1439947 6/1976 United Kingdom .

*Primary Examiner*—Sam Silverberg
*Attorney, Agent, or Firm*—Edward B. Gregg; Urban H. Faubion; John Y. Chen

[57] ABSTRACT

Process for applying a protective coating to a metal substrate which provides a thermal barrier and a barrier against oxidation of the substrate. The coating material is a mixture of two metals $M_1$ and $M_2$, e.g., cerium ($M_1$) and cobalt ($M_2$), one of which when exposed to an atmosphere containing a low partial pressure of oxygen and at a high temperature forms a stable oxide, the other of which does not form a stable oxide under such conditions. A coating consisting of such a metal alloy or mixture is subjected to such conditions to produce an outer oxide layer of metal $M_1$ and an inner metal layer of $M_2$ alloyed with one or more components of the substrate. The oxide layer provides thermal and oxidation protection and the inner layer bonds the coating to the substrate.

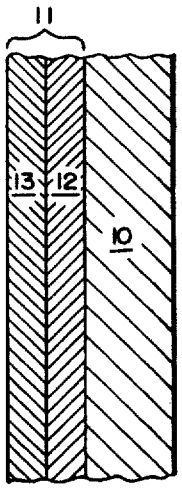

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 4–19:

The metals $M_1$ and $M_2$ are selected according to the following criteria: $M_1$ forms a thermally stable oxide when it is exposed to an atmosphere containing a small concentration of oxygen such as that produced by a mixture of carbon dioxide and carbon monoxide at a temperature of about 900° C. The metal $M_2$, under such conditions, does not form a stable oxide and remains entirely or substantially entirely in the form of the unoxidized metal. Further, $M_2$ is compatible with the substrate alloy in the sense that it extracts one or more of the components of the substrate to form an intermediate layer between the oxide outer layer (resulting from oxidation of $M_1$) and the substrate, such intermediate layer being an alloy of [$M_1$] *$M_2$* and the extracted component or components and serving to bond the oxide layer to the substrate.

Column 2, lines 25–50:

When a coating of suitable thickness has been applied to the substrate alloy by the dip coating process or by the slurry process described above (and in the latter case after the solvent has been evaporated and the $M_1/M_2$ metal alloy or mixture is fused onto the surface of the substrate) the surface is then exposed to a selectively oxidizing atmosphere such as a mixture of carbon dioxide and carbon monoxide (hereinafter referred to as $CO_2/CO$). A typical $CO_2/CO$ mixture contains 90 percent of $CO_2$ and 10 percent of CO. When such a mixture is heated to a high temperature, an equilibrium mixture results in accordance with the following equation:

$$CO+\tfrac{1}{2}\,O_2=CO_2$$

The concentration of oxygen in this equilibrium mixture is very small, e.g. at 800° C., the equilibrium oxygen partial pressure is approximately [$2\times10^{-7}$] *$2\times10^{-17}$* atmosphere, but is sufficient at such temperature to bring about selective oxidation of $M_1$. Other oxidizing atmospheres may be used, e.g., mixtures of oxygen and inert gases such as argon or mixtures of hydrogen and water vapor which provide oxygen partial pressures lower than the dissociation pressures of the oxides of the elements in $M_2$, and higher than the dissociation pressure of the oxide of $M_1$.

AS A RESULT OF REEXAMINATION, IT HAS BEEN DETERMINED THAT:

Claim 1 is determined to be patentable as amended.

Claims 2–7, dependent on an amended claim, are determined to be patentable.

1. A method of coating a metal substrate with a [protective coating which comprises] *metal oxide to provide a thermal barrier, said method comprising:*

(a) providing a substrate metal to be coated, said substrate being a structural article suitable for use in a mechanical structure having high mechanical strength, (b) providing an alloy or mixture of at least one metal $M_1$, and at least one other metal $M_2$, *$M_1$ constituting not less than 50% by weight of the alloy or mixture, $M_2$ being present in substantial amount but not exceeding 50% by weight of $M_1$ and $M_2$, $M_1$ and $M_2$ being* selected according to the following criteria:

(1) $M_1$ is susceptible to oxidation by molecular oxygen at an elevated temperature in an atmosphere having a very small partial pressure of oxygen, such oxidation resulting in a stable oxide of $M_1$, (2) $M_2$ does not form a stable oxide *and remains substantially entirely unoxidized* under such conditions [and it forms an alloy with at least one component of the substrate on heat treatment of the coated material];

(c) applying such alloy or mixture to a surface of the substrate, [under conditions such that the surface only is coated with an alloy of $M_1$ and $M_2$ and] *(1) by dipping the substrate in a molten alloy of $M_1$ and $M_2$ or (2) by applying a slurry in a volatile liquid of the metals $M_1$ and $M_2$ in finely divided form either as the separate metals or as an alloy of $M_1$ and $M_2$, then vaporizing the solvent and fusing the metals;*

(d) effecting selective oxidation of $M_1$ at an elevated temperature [in the coating] without substantial oxidation of $M_2$.

[(e) the proportion of $M_1$ to $M_2$ in said alloy or mixture of $M_1$ and $M_2$ being substantial and sufficient to result in a coating containing sufficient oxide of $M_1$ to function as a substantial thermal barrier,]

*(e) said method resulting in a coating which is bonded to the substrate, said coating having an intermediate bonding layer and an outermost dense oxide layer which is substantially entirely an oxide of $M_1$ and serves as a protective thermal barrier for the substrate, said intermediate bonding layer having (1) an interaction zone and (2) a subscale zone, said interaction zone being composed substantially entirely of unoxidized $M_2$ which is bonded to the substrate by the alloying of at least one component of $M_2$ with at least one component of the substrate, and said subscale zone being composed of an adequate amount of $M_2$ and the oxide of $M_1$ so as to establish a firm bond with the interaction zone, said outermost dense oxide layer and said intermediate bonding layer being formed by said step (d), said intermediate bonding layer serves to bond said outermost dense oxide layer to the substrate.*

* * * * *